US007681828B2

(12) United States Patent
Eshed et al.

(10) Patent No.: US 7,681,828 B2
(45) Date of Patent: Mar. 23, 2010

(54) DEVICE FOR WINDING TAPES

(76) Inventors: Shlomo Eshed, Moshav Avial, Moshav Avial (IL) 37835; Omer Eshed, Moshav Avial, Moshav Avial (IL) 37835

( * ) Notice: Subject to any disclaimer, the term of this patent is extended or adjusted under 35 U.S.C. 154(b) by 3 days.

(21) Appl. No.: 12/067,807

(22) PCT Filed: Sep. 21, 2006

(86) PCT No.: PCT/IL2006/001114

§ 371 (c)(1),
(2), (4) Date: Mar. 23, 2008

(87) PCT Pub. No.: WO2007/034491

PCT Pub. Date: Mar. 29, 2007

(65) Prior Publication Data

US 2008/0282651 A1 Nov. 20, 2008

(30) Foreign Application Priority Data

Sep. 23, 2005 (GB) ..... 0519367.7

(51) Int. Cl.
*B21C 47/14* (2006.01)

(52) U.S. Cl. ..... 242/441.3; 242/439

(58) Field of Classification Search ..... 242/438.1, 242/439, 439.1, 439.2, 439.3, 441.2, 441.3, 242/442, 446, 447
See application file for complete search history.

(56) References Cited

U.S. PATENT DOCUMENTS

| | | | | | |
|---|---|---|---|---|---|
| 1,795,876 | A | * | 3/1931 | McCoy | 57/15 |
| 2,274,833 | A | * | 3/1942 | Hubbard | 242/442 |
| 2,544,442 | A | * | 3/1951 | Boyce | 242/441.2 |
| 2,564,016 | A | * | 8/1951 | Maddic | 242/441.2 |
| 3,000,167 | A | * | 9/1961 | Pierce, Jr. | 242/441.2 |
| 3,553,061 | A | | 1/1971 | West et al. | |
| 3,590,567 | A | * | 7/1971 | Bonikowski et al. | 242/421.7 |
| 4,610,403 | A | * | 9/1986 | Goekler et al. | 242/439.5 |
| 4,827,700 | A | | 5/1989 | Rampe et al. | |
| 5,660,348 | A | * | 8/1997 | Sansone et al. | 242/439 |
| 6,662,808 | B2 | * | 12/2003 | Leason et al. | 132/212 |

* cited by examiner

*Primary Examiner*—Emmanuel M Marcelo

(57) ABSTRACT

A device for winding tapes around a longitudinal object, using a supportive hollow cylinder surrounding the object, and a ring rotatable around the cylinder. A spool shaft connected at one end to the rotatable ring bears a spool on which a tape is disposed. The spool is made to rotate around the longitudinal object dispensing the tape to subsequently wrap the object. A driving mechanism may be employed for rotating the rotatable ring and spool.

1 Claim, 2 Drawing Sheets

DEVICE FOR WINDING TAPES

FIELD OF THE INVENTION

The present invention related to an apparatus for application of tape lengthwise over elongated devices, typically the invention relates to packaging binding by and winding of tape over tubing and cables.

BACKGROUND OF THE INVENTION

Wrapping of objects is performed for various purposes in the industrial and transportation arenas, and for various maintenance reasons. In the industry, packaging is oftentimes accomplished by wrapping the surface of the objects with sheets of plastic, thus binding the contents by the sheer tensile embracement of the encasing plastic sheet. Wrapping can have an effect on the stability of packaged objects, such that the tight packing avoids breakage and dismantlement of assemblages of encased objects. Adhesive tape is also used in combination with other forms of packaging materials to consolidate packages. Winding thermal isolation tape on refrigeration hoses, cables and pipes is a difficult task that consumes a considerable amount of time, especially if the length of the elements to be wound is considerable. The action of wrapping cables, pipes, tubes, and the like, either individually or in assemblages when done in the construction site, is tedious. The workers in the field would benefit considerably from an automated device that would perform the wrapping with accuracy and quality while requiring little human supervision.

DETAILED DESCRIPTION OF THE PRESENT INVENTION

Figure 1:
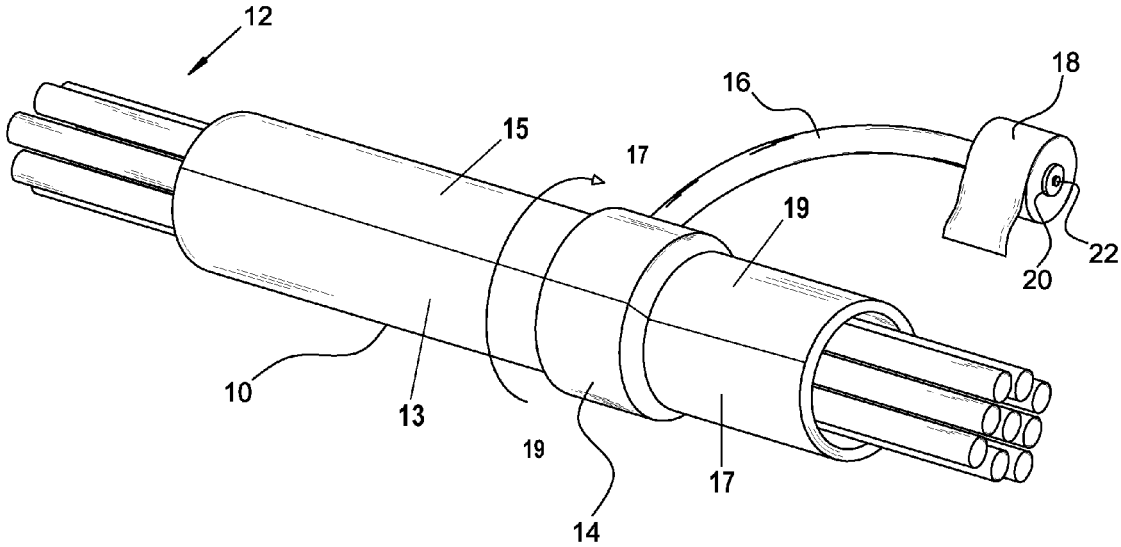
FIG. 1 is a schematic isometric description of a device of the invention.

The device of the invention is useful for the application of wrapping agents, typically in the form of tape over any extended articles, such as hoses and cables. First, reference is made to FIG. 1 which describes the general aspects of such an application device. Supportive hollow cylinder (SHC) 10 closes in on a cable cluster 12. Rotating ring 14 is rotatable around SHC 10, driving the attached spool shaft 16. Spool 18 is revolvable around pivot 20 while the freedom to revolve is adjustable by screw 22. Rotating ring 14 is either manually or machine driven. The application method as facilitated by the device of the invention is further explained with reference to FIG. 2. Tape application device (TAD) 40 employs rotatable ring 42 that is manually or mechanically powered. Limiters 44 keep the ring in place along SHC 46. Spool pivot 50 is attached to spool shaft 48, supporting spool 52. A rate limiting mechanism/button 54 is actuated by the user to regulate the amount of slack in tape 58. The turning of rotatable ring (RR) 42 causes tape 52 to unfold and wrap around elongated objects 60.

Powering the Winding Action

Rotation of the RR 14 and appendages thereof can be effected manually. This rotation can be carried out by a mechanism resembling a fishing spinning reel. One mechanized option for achieving the rotation would be a dedicated electric motor installed with its axis of rotation in parallel to the base cylinder, whereby a gear (not shown) transfers the torque to the RR 14. In another embodiment of the invention, the rotating ring of the TAD is powered by a general purpose electrical motor such as a drill motor using a suitable gear and an installation adapter. Useful actuation means are pneumatic and hydraulic actuators, with or without the electronic circuits to control speed, distance (tape spacing), total length covered and tension. The advancement of the TAD in the direction of arrow 62 is typically carried out manually and the pace is typically controlled by the operator. The RR 14 can be powered by hydraulic or pneumatic motor.

The RR in other embodiments may be powered directly by a motor without the use of a gear if the RR or a art a motor. For example, in electric motors, the armature may be a part of the RR.

Tape Windings Configurations

Figure 2:
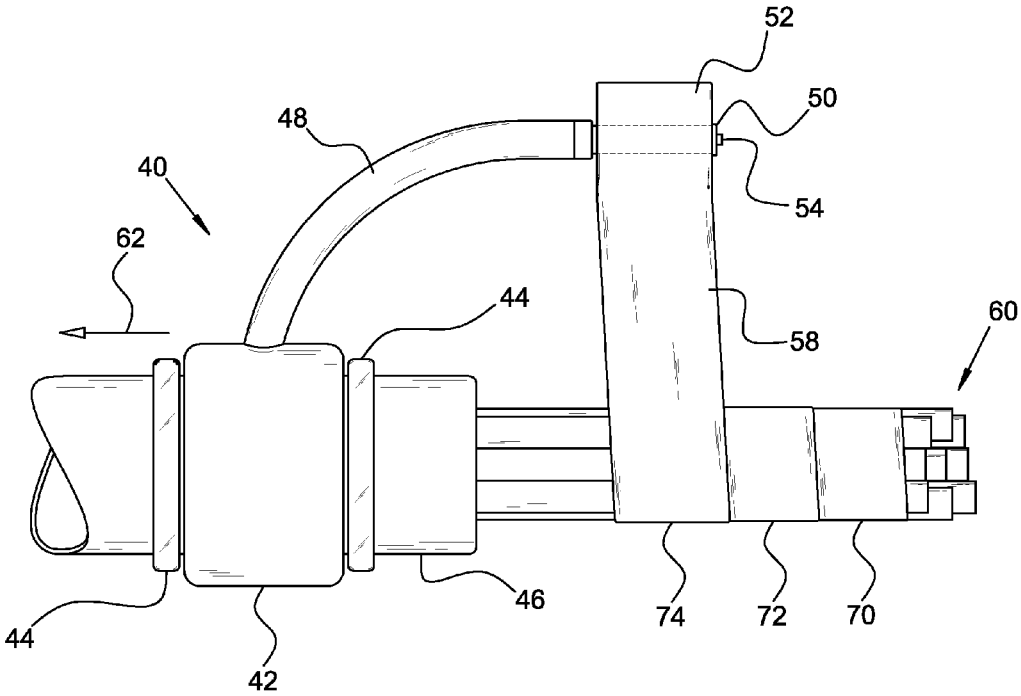
FIG. 2 is a schematic side view description of a device of the invention in a working state.

As depicted in FIG. 2, loops 70, 72 and 74 are overlapping, the degree of overlap or gap (spacing of the tape means it does not have to overlap) may be dictated by the rotation rate of the ring 42, and by the rate of advancement of the TAD along the cluster of longitudinal objects 60. The rate of advancement of the TAD also dictates the angle with which tape 58 is slanted with respect of the TAD.

The rate of spool winding is controlled to some extent by a frictional restriction mechanism that can be used to provide varying degrees of frictional arrest exerted on the spool. The variation is brought about by a screw, bolt or a wedge that hinders the turning of the spool to a desired degree.

OTHER EMBODIMENTS

Figure 3:
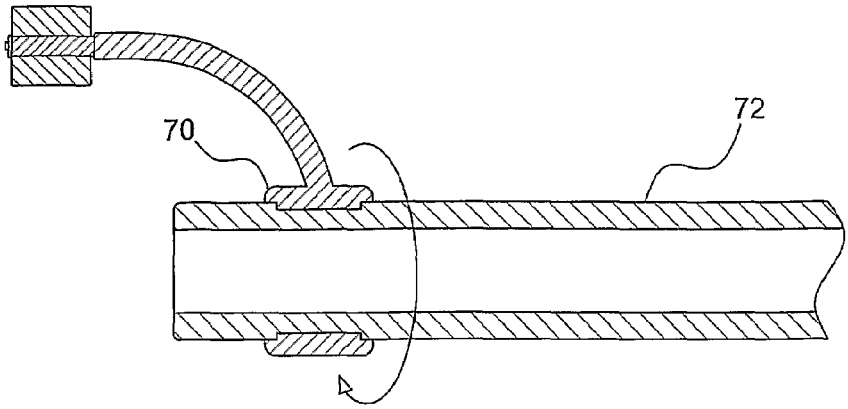
FIG. 3 is a schematic cross sectional view in system of the invention employing a ring rotatably coupled to a middle portion of the supportive hollow cylinder
Figure 4:
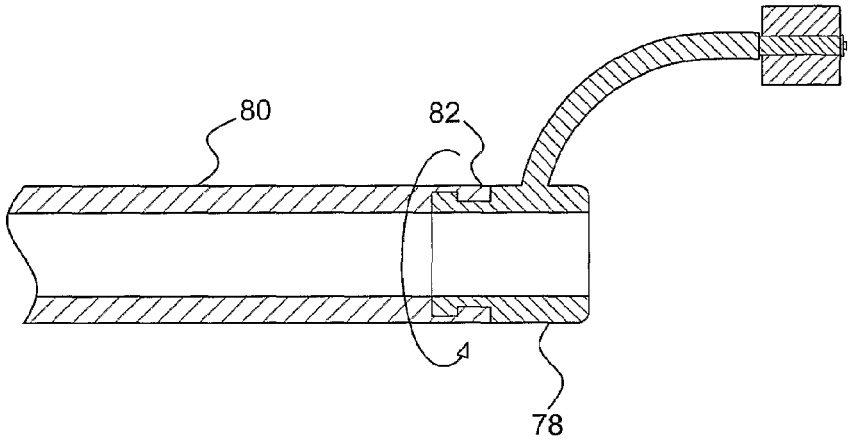
FIG. 4 is a schematic cross sectional view in system of the invention employing a ring rotatably coupled to an end of the supportive hollow cylinder.
Figure 5:
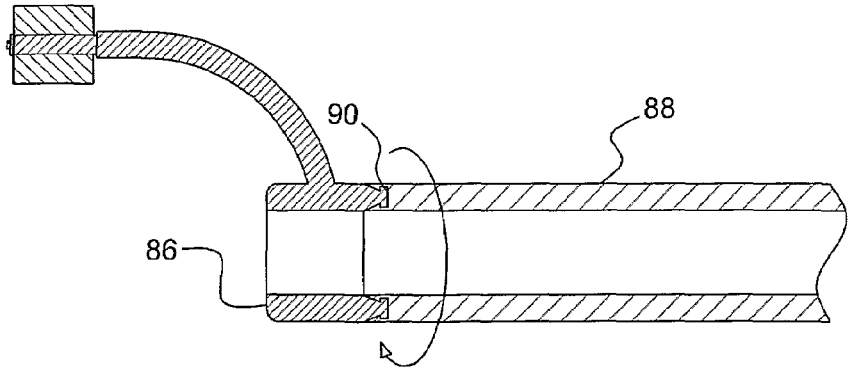
FIG. 5 is a schematic cross sectional view in system of the invention employing a ring rotatably coupled to an end of the supportive hollow cylinder.

In order to apply the TAD on a longitudinal object having no loose end, a sliced SHC and a rotatable ring are employed. Accordingly, the SHC appears as halved lengthwise by slicing at two longitudinal lines, forming two longitudinal sectors 13 and 15 of a cylinder 10. The two halves, equal or not, are interconnected at one common edge by a swivel joint and at the other edge both are interconnected by a common latch so that when latched they form a whole cylinder. The latch and swivel are hidden from the outer surface so as to allow free rotation of the RR 14. The RR 14 is likewise constructed, having two sectorial halves 17 and 19, connected at one is common edge by a swivel connection and at another edge by a latch. The RR 14 may be a part of an electric or hydraulic motor, obviating the need for gear. For example, the RR 14 or appendages may perform the role of a commutator by application of the appropriate coils. In FIG. 3 RR 70 forms a rotating coupling with SHC 72. In FIG. 4 RR 78 forms a rotating coupling at the end of SHC 80. The coupling is secured by a circumferential ridge 82 of the SHC rotatable against the RR. In FIG. 5 RR 86 is coupled to the end of SHC 88. The coupling is secured in this case by circular projection 90 completely residing within the wall of SHC 88.

More than one spool can be employed at once, typically by installing more than one spool shaft on the RR. In such embodiments, wrapping/taping, may be denser as compared to single spool embodiments. Even distribution of spools around the RR is better affected mechanically, potentially resulting in smoother rotation. The more balanced distribution of stress around the RR may result in lesser frictional losses in the rotation.

Additionally, the angle at which the spool is disposed with respect of the SHC is variable, such that the spool may be slanted to accommodate the rate of advancement of the TAD. Meaning, a fast advancement of the TAD is associated with a larger deviation of the tape from the perpendicular to the TAD. In such a case it may be desirable to change the angle of the spool to correspond with the angle of the tape with respect to the perpendicular to the TAD.

Uses of the Device of the Invention

The device of the present invention is used as a winding tool for providing a coat to a single longitudinal object or to an assemblage of parallel objects. Examples of appropriate uses are wrapping of assemblages of electric cables, assemblage of tubes, pipes such as in the case of refrigeration systems, a combination of tubes and electric cables. The tape, when wrapped, may serve as a binder for the assemblage and or as an isolating agent, as a fire proofing wrap, water or chemical proof wrap.

The coating applied by the method of the invention is applicable for many environmentally dependent applications, such as protection against adverse temperatures or humidity. The system of the invention may be used for coating of cardboard boxes as a protection against humidity, water of dirt.

The system of the invention may also be used for winding electric wires around objects as for the production of coils.

The invention claimed is:

1. A device for winding tape around at least one elongated object comprising:

a supportive hollow cylinder;

a ring rotatable around said cylinder; and at least one spool shaft connected at one end to said rotatable ring, wherein said supportive hollow cylinder and said ring are each longitudinally sectioned whereby they comprises complementary portions facilitating applying the advice on said at least one elongated object, and the advice is advance-able with respect to the at least one elongated object.

* * * * *